US006042415A

United States Patent [19]

White et al.

[11] Patent Number: 6,042,415

[45] **Date of Patent: *Mar. 28, 2000**

[54] INSULATION DISPLACEMENT CONNECTOR

[75] Inventors: Rowland Spencer White, Lunenburg, Mass.; David Ernest Ivey, Whitchurch, United Kingdom

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/793,895

[22] PCT Filed: Sep. 13, 1995

[86] PCT No.: PCT/GB95/02159

§ 371 Date: May 12, 1997

§ 102(e) Date: May 12, 1997

[87] PCT Pub. No.: WO96/08852

PCT Pub. Date: Mar. 21, 1996

[30] Foreign Application Priority Data

Sep. 13, 1994 [GB] United Kingdom ..... 9418417

[51] Int. Cl.[7] ..... H01R 4/24; H01R 4/26; H01R 11/20

[52] U.S. Cl. ..... 439/396

[58] Field of Search ..... 439/401, 403, 439/404, 396

[56] References Cited

U.S. PATENT DOCUMENTS

| | | | |
|---|---|---|---|
| 3,798,587 | 3/1974 | Ellis, Jr. et al. | 439/403 |
| 4,118,095 | 10/1978 | Berglund et al. | 439/403 |
| 4,262,985 | 4/1981 | Muehlhausen, II | 439/401 |
| 5,302,137 | 4/1994 | Suffi | 439/403 |

FOREIGN PATENT DOCUMENTS

| | | |
|---|---|---|
| 0323340 | 7/1989 | European Pat. Off. . |
| WO92/22941 | 12/1992 | WIPO . |

*Primary Examiner*—Richard D. Lovering
*Attorney, Agent, or Firm*—A. A. Tirva

[57] ABSTRACT

An insulation displacement connector, which may be compatible with two or more types of insertion tools, has a plurality of teeth defining slots therebetween for wire insertion. A ledge is formed a the base of the teeth as one, non-castellated, side thereof and an anvil is provided on the ledge for each slot. The anvil extends into the slot and provides a terminating surface for a chisel type insulation displacement connector.

4 Claims, 1 Drawing Sheet

INSULATION DISPLACEMENT CONNECTOR

This is an application filed pursuant to 35 U.S.C. §371 in connection with International Application No. PCT/GB95/02159 filed Sep. 13, 1995.

This invention relates to insulation displacement connectors (IDC's) used to terminate insulated wires in voice and data communications systems.

Insulation displacement connectors are very well known in the voice and data communications industries. Typically an IDC comprises a metallic blade contact receiving and establishing contact with an insulated wire, and a housing or connector block. Usually, a number of contacts are housed in a single connector block, typically 4 or 8. Each contact has a pair of tines at one end for receiving the wire or wires to be connected. Some contacts will have a further pair at their opposite end for connection to a wiring block or individual wires, or will be provided with, for example, a tail for connection to a PCB, depending on the application. The pair of tines for receiving a wire is located in the housing in between teeth in the housing which define a slot into which a wire is inserted using an insertion tool. The wire is guided, by the slot and tool, between the tines which are displaced less than the width of the wire insulation. The manner of displacement depends on the type of contact design used. Accordingly, the insulation is cut or displaced and contact is established between the wire and contact.

Such an IDC is known in US patent U.S. Pat. No. 4,834,668 which describes an IDC having a slot housing two tines for displacing the insulation of a wire to establish contact. This IDC has a wire guide for suporting the wire through the connector, and a wire termination pad against which the wire is trimmed using a chisel type inserter tool.

U.S. Pat. No. 4,964,812 (Siemon) discloses an IDC contact which comprises two opposed cantilevered beams each comprising a pair of tines extending from a central portion. Each tine pair is separated by an elongate opening along a point of its length and is formed from an original cantilevered beam by shearing along a shear axis which forms the cutting surface for displacing the insulation on a wire.

Another type of IDC contact is used in the 110 type connector of AT&T Corporation. The displacement contacts are described in a number of US patents, for example: U.S. Pat. No. 3,611,264 (Ellis), U.S. Pat. No. 3,798,587 (Ellis) and U.S. Pat. No. 4,118,095 (Berglund).

As there are a number of different IDC housing designs, there are a number of different industry standard wire termination tools. Our copending application WO 92/22941 describes a housing design that can locate the terminating heads of two different tools, by the incorporation of horizontal castellations in one or both lateral walls of the connector. These horizontal castellations serve to locate the inserter blades of both tool types in such a manner as to prevent the tool blade from damaging the connector contact during wire insertion. Such wire insertion tools are well known and insert wires in the contact tines and then cut off the excess length. In some cases the tool includes a cutting blade in others it does not. There are two major types of wire insertion/termination tools; those compatible with connectors made by Krone AG of Berlin, Germany, and those made by AT&T Corporation and compatible with their 110 series of connectors. Neither tool can be used to insert wires in connectors of the other manufacturer. Consequently, an installer must carry two types of wire insertion tools.

Our copending application, WO 92/22941, thus describes a connector block which may receive both of the above types of wire insertion tool. This connector block accepts both the chisel type cutter of the AT&T 110 tool which slices through the excess wire as well as, for example, the Krone inserter tool which employs a scissor-type cutter. A feature of the AT&T 110 tool is its ability to terminate wires fed into the connector from either side of the row of contacts when used with the AT&T connector. Similarly, the connector block of WO 92/22941 also accepts wires for termination in either direction by the AT&T tool. However, this connector may fail to cut off the excess wire when terminating wires inserted from one of the two sides of the connector block.

The connector block of WO 92/22941 is provided with castellations which serve to locate either the AT&T tool or the Krone tool. Each tool requires that the wire to be terminated is supported at the base of the slot into which the wire is inserted. In the case of the AT&T tool, the wire is supported by a ledge at the base of the slot. The ledge supports the wire so that the blade of the tool cuts the wire by passing across the wire and across the face of the ledge. The ledge must, therefore, protrude sufficiently to support the wire, but not so far that the chisel blade meets the supporting surface of the ledge thereby causing damage to the ledge. Similarly, the Krone scissor type cutter requires that the wire is supported at the slot base. However, the Krone insertion tool operates more effectively if the ledge supporting the wire is lower (with the slot opening upper most) than that of a connector suitable for the AT&T tool. Accordingly, the connector block described in WO 92/22941 provides a ledge at one height for use with the AT&T tool, on one side of the connector; and a ledge at a lower height on the other side of the connector, for use with the Krone insertion tool. The connector block thus accepts wires for termination on one side of the connector with the AT&T tool, and on the other side of the connector with the Krone tool. As noted above, however, the AT&T tool may be used to terminate wires in either sense when used with the AT&T connector block.

We have appreciated the desirability of providing a connector block which may be used with two or more types of inserter tool, and which may terminate wires inserted from one side of the block with either tool.

Accordingly there is provided an insulation displacement connector comprising a housing retaining an insulation displacement contact, the housing having a pair of teeth defining a slot therebetween for insertion of a wire to establish conductive contact with the contact, the housing also having a support at the base of the slot for supporting a wire, characterised in that the support has two or more supporting levels for supporting a wire at two or more levels to allow termination of the wire with at least two different termination tools.

A connector block according to the invention may thus accept two or more insertion tools which may require two or more different supporting levels for an inserted wire.

We have further appreciated that an IDC which is compatible with two or more types of insertion tool, should reliably terminate and cut off wires inserted from either side of the connecting block.

Accordingly in a preferred embodiment, one side of the teeth defining the slot are castellated and the other side flat, the support being arranged on the flat side of the teeth.

This further has the advantage of providing compatibility with two particular types of inserter tool; the Krone type and the AT&T 110 type. The support provides support for a wire to be cut off using the blade type inserter tool at one level without impeding the acting of the scissor-type inserter tool which requires the wire supported at another level.

Preferably, the support comprises a ledge formed at the base of the teeth extending laterally along the housing, with an anvil arranged on the ledge, providing a simple construction for a two level support.

Embodiments of the invention will now be described, by way of example only, and with reference to the accompanying drawings in which :

Figure 1:
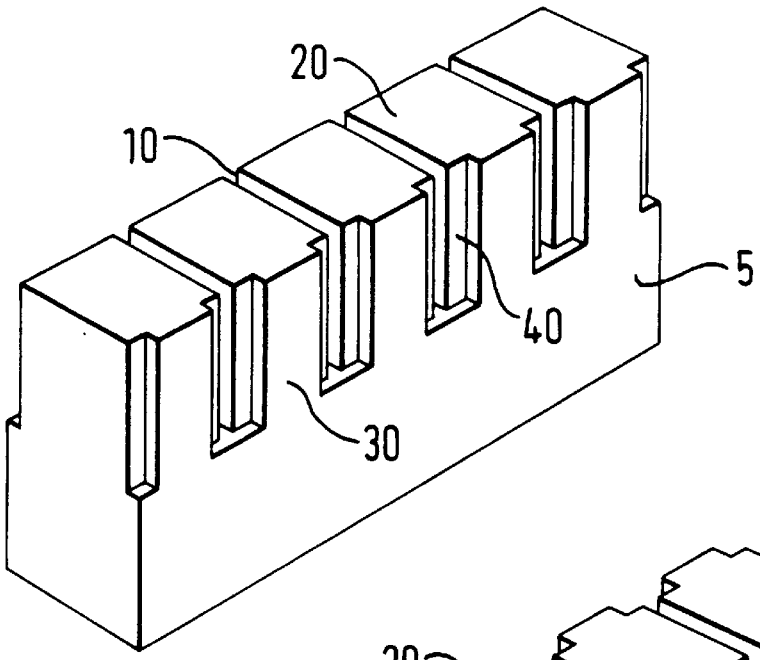
FIG. 1 is a perspective view of a prior art IDC housing from a first side.

The housing shown in FIG. 1 is castellated in the manner disclosed in our copending application WO 92/22941. Slots 10 are formed between adjacent teeth 20 which form a part of the housing These slots each house an electrical contact (not shown) which establishes conductive contact with an insulated wire upon insertion of that wire into a slot. The face of the connector 5 shown in FIG. 1 has relatively narrow castellation portions 30 formed as recesses and relatively wide castellation portions 40. The wide castellation is suitable for location the Krone AG type insertion tool whereas the narrow castellation is suitable for the AT&T tool.

Figure 2:
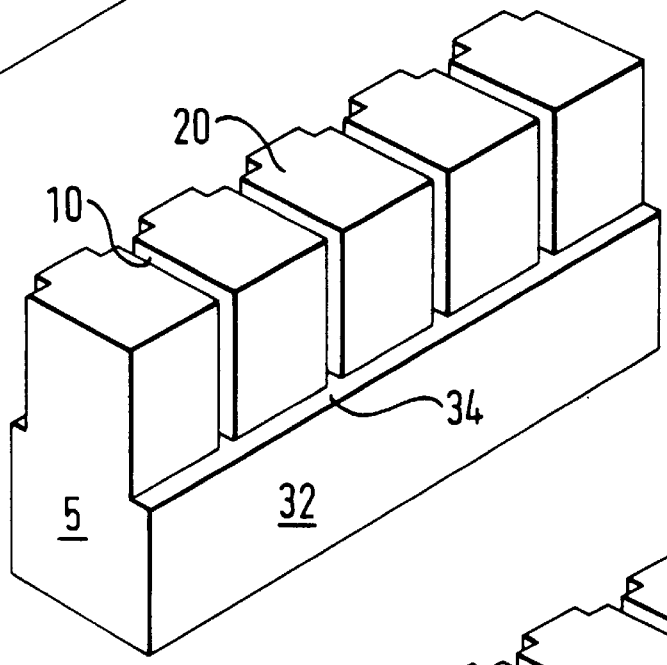
FIG. 2 is a perspective view of the IDC housing of FIG. 1 from the opposite side.

FIG. 2 shows the opposite face of the prior art connectors. It will be seen that castellations are provided on one face only, although castellations could be provided on both faces or alternately on one side and then the other for adjacent teeth 20. In FIG. 2, the teeth do not extend laterally to the lower face 32 of the housing defining a lateral ledge 34 at the base of the teeth.

Figure 3:
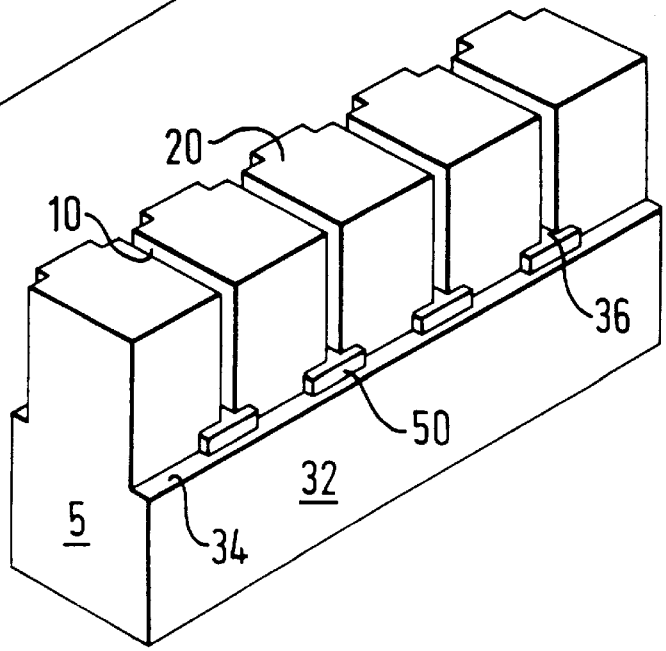
FIG. 3 is a perspective view of a connecting block embodying the present invention.

The embodiment of the invention as shown in FIG. 3 differs from that of FIGS. 1 and 2 only by the inclusion of an anvil 50 positioned at the base of each slot 10 of the connecting block such that it sits on the lateral ledge 34. Each anvil is T shaped and is positioned on the flat, non-castellated side of the housing, with the tail piece 36, extending into the slot. One T-shaped anvil is provided for each slot. The anvil 50 supports a wire inserted into the slot 10 by an insertion tool, so that an insertion tool with a 'chisel' type blade may cut the wire against the anvil So. In this embodiment which has castellations 30 and 40, the connecting block will also accept the 'scissor' type termination tool such as the Krone type. The addition of anvil 50 does not impede the action of this type of tool. The anvil may be formed of plastics or other suitable material.

The anvil described provides support for a wire at two possible levels. The upper level, provided by the upper surface of the anvil, supports a wire for termination by a 'chisel' type termination tool. An inserted wire is terminated by the blade passing through the wire and onto the upper surface of the anvil. The lower level of support is provided by the ledge 34. The ledge supports a wire to be terminated with a 'scissor' type insertion tool. The wire rests on the ledge which prevents the wire from escaping from the jaws of the scissor blades as they close upon the wire. As the scissor action is at a small distance from the connector block, the scissor blades pass across the vertical face of the anvil, and above the supporting surface of the ledge. Consequently, the two level support described allows two termination tools, each operating at a different support level, to terminate an inserted wire.

Whilst the invention has been described with respect of one preferred embodiment, the invention applies to any IDC which may receive a 'chisel' type termination tool. The IDC need not have castellations and the type of electrical contact may be planar, V-shape or other suitable shapes.

The anvils have been described as separate pieces for each slot. However, those skilled in the art will appreciate that a single elongate anvil piece could extend along the ledge, with, if necessary, a series of tails extending into each slot.

We claim:

1. An insulation displacement connector comprising a housing retaining an insulation displacement contact in a wire receiving slot, the housing having at least a pair of teeth to define therebetween said slot for receiving a wire so that a conductive contact is established between said wire and said insulation displacement contact when said wire is terminated to said insulation displacement contact, one side of each of said teeth is flat and the other side of each of said teeth is castellated to accept at least two different termination tools and a support arranged adjacent the flat side of said teeth for supporting said wire to be terminated, characterized in that the support has two or more supporting levels so arranged to support said wire at two or more levels to allow termination of the wire with at least two different termination tools.

2. An insulation displacement connector according to claim 1, wherein the support comprises a ledge formed at the flat side of the teeth, said ledge extending uninterrupted laterally along the teeth to provide a first supporting level and an anvil arranged on the ledge with respect to said wire receiving slot to provide a second supporting level.

3. An insulation displacement connector according to claim 2, wherein the anvil is T shaped and has the tail portion of the T shaped anvil extending into the slot.

4. An insulation displacement connector according to claim 1, wherein the housing has a plurality of slots and retains a plurality of contacts, each of which slots having an anvil at its base.

* * * * *